United States Patent [19]

Anderson

[11] 4,139,054

[45] Feb. 13, 1979

[54] PLATE-FIN HEAT EXCHANGER

[75] Inventor: J. Hilbert Anderson, York, Pa.

[73] Assignee: Sea Solar Power, York, Pa.

[21] Appl. No.: 846,318

[22] Filed: Oct. 28, 1977

[51] Int. Cl.[2] ..... F28F 3/10

[52] U.S. Cl. ..... 165/76; 165/82; 165/83; 165/134 R; 165/166

[58] Field of Search ..... 165/76, 78, 82, 134, 165/166, 83

[56] References Cited

U.S. PATENT DOCUMENTS

| | | | |
|---|---|---|---|
| 2,595,308 | 5/1952 | Simpelaar | 165/76 |
| 3,542,124 | 11/1970 | Manfredo | 165/166 |
| 3,633,661 | 1/1972 | Duncan et al. | 165/166 |
| 3,986,549 | 10/1976 | Huggins et al. | 165/76 |

*Primary Examiner*—Charles J. Myhre

*Assistant Examiner*—Sheldon J. Richter

*Attorney, Agent, or Firm*—Kemon & Estabrook

[57] ABSTRACT

An apparatus of the heat exchanger type embodying a plurality of plates arranged in spaced parallel relation with one another to define a stack of exchanger plates. The stack of plates are arranged to define fluid and vapor passages with separators being positioned in said passages to maintain the plates in spaced relation. The stack of plates are positioned between pressure plates which have top, bottom, and side covers either supported thereon or connected thereto with the entire assembly held together by suitable clamp plates. The side covers utilize fluidic means to apply pressure to the pressure plates so that said heat exchanger utilizes the general principle of nearly equalized pressure between outside and interior surfaces.

20 Claims, 5 Drawing Figures

PLATE-FIN HEAT EXCHANGER

BACKGROUND OF THE INVENTION

The present invention is directed to heat exchangers of the type utilizing a liquid and a vapor in order to effect the transfer of heat.

The prior art has disclosed that in a sea thermal power plant it is advantageous to submerge heat exchangers in the ocean to a depth where the ocean water pressure is approximately equal to the vapor pressure of the evaporating liquid inside of the boiler or the condensing vapor inside of the condenser. This principle enables the walls of the heat exchanger to be formed from much thinner material as they do not need to be so strong thereby reducing cost inasmuch as less material is required.

In heat exchangers of the afore-mentioned type the walls or partitions defining the passages are formed of thinner material making it practical to use material of lower conductivity. It has been found that titanium could easily be used instead of aluminum without seriously reducing heat transfer rate. In an equalized pressure heat exchanger the exchanger is more leak tolerant thus reducing down time and maintenance costs. The foregoing features are in many instances disclosed in Applicant's prior U.S. Pat. No. 3,312,054 dated Apr. 4, 1967 wherein same deals with heat exchangers in conjunction with a sea water power plant.

SUMMARY OF THE INVENTION

The present invention is directed to a heat exchanger which utilizes the general principles of nearly equalized pressure between outside and interior surfaces. The heat exchange plates are formed as a stack which is enclosed within pressure plates that have cover members associated therewith. In addition, a top and a bottom cover are associated with the cover members with clamp plates engaging and holding the covers with the pressure plates. An expandable medium is interposed between certain of the cover members and the pressure plates in order to create and develop an outside pressure with respect to the stack of plates in the heat exchanger.

Furthermore the stack of plates constitute heat transfer plates and as concerns the gas or vapor passageways these are provided with wave-shaped plates or plates of various shapes which provide sufficient strength to hold the transfer plates apart. These various shaped plates act as separator plates that add strength and rigidity to the transfer plates and same can be formed from highly conductive materials. In addition, said separator plates may have their surfaces treated to promote drop-wise condensation or holes may be formed in said plates to break up condensate streams flowing through said channels. The transfer plates that define the water passages in said heat exchanger are provided with separators to hold the plates of the stack apart.

DESCRIPTION OF THE PREFERRED EMBODIMENT

Figure 1:
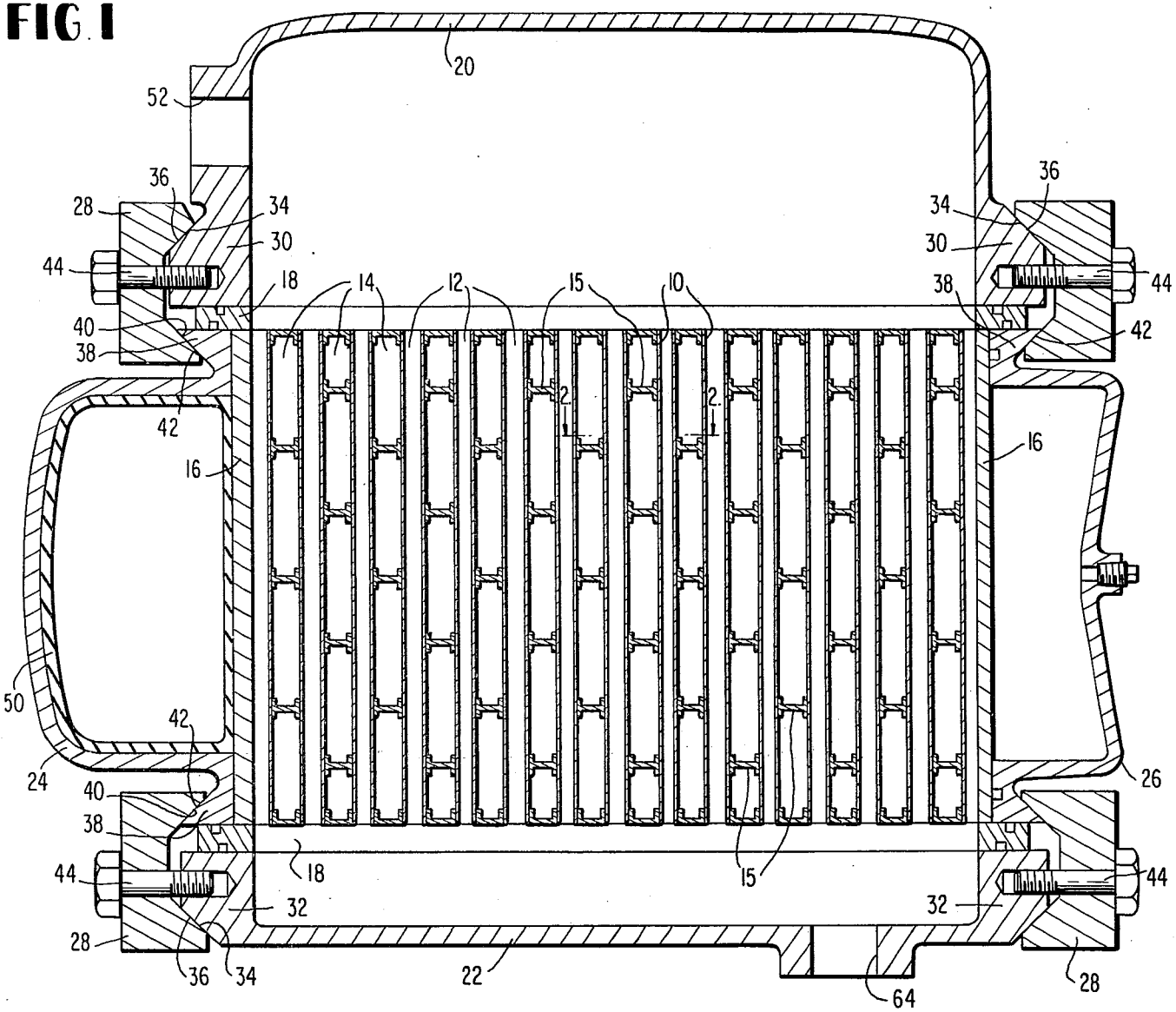
FIG. 1 is a vertical sectional view of a heat exchanger embodying the present invention.

As shown in FIG. 1 the heat exchanger is a vapor condenser and consists of a plurality of plate members 10 that are assembled in a stack. The plate members 10 are arranged in pairs so as to define between adjacent pairs vapor passages or passageways 12 with water passages 14 provided between the plates of each pair. The passages 14 as defined by the plate members 10 have a plurality of separator strips or plates 15 arranged in horizontal planes therein to define a plurality of horizontal water passages 14. The plate members 10 are assembled in a stack form between the pressure plates 16, the ends of which have gasket flanges 18 positioned thereon and against the edges of the plate members 10. The surfaces of the gasket flanges which engage or abut the edges of the plate members 10 are provided with grooves, not shown, into which a viscous sealant is injected for sealing the edges of the plate members 10 to the gasket members.

The gasket flanges 18 and the stack of plate members 10 are provided with top and bottom cover members 20 and 22. The pressure plates 16 have associated therewith covers 24 and 26 and these covers are secured to the top and bottom cover members 20 and 22 by clamp plates 28. The top and bottom cover members 20 and 22 are formed with enlarged rim portions 30 and 32, respectively, which portions engage the gasket flanges 18. The rim portions 30 and 32 of the top and bottom cover members are each formed with an inclined surface 34 that is engaged by a complimentary surface 36 provided on the clamp plate 28. In addition, the covers 24 and 26 have enlarged rim portions 38 with inclined surfaces 40 that engage complimentary surfaces 42 on the clamp plate 28. The clamp plates 28 have suitable bolts 44 which extend into threaded apertures provided in the rim portions 30 and 32 of the top and bottom cover members 20 and 22. Thus as said bolts are tightened the inclined surfaces 36 of the clamping plates draw the top and bottom cover members tightly into engagement with the gasket flange 18 while drawing the enlarged end portion 38 of the cover members 24 and 26 into engagement with the gasket flange 18, and at the same time compressing the side covers 24 and 26 against the pressure plates 16 and the stack of plate members 10, and thereby compressing the plates towards one another.

Figure 2:
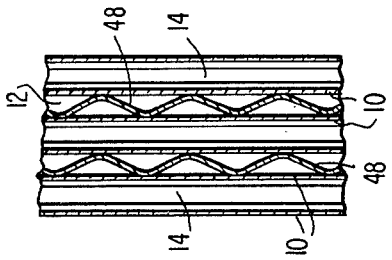
FIG. 2 is a detailed sectional view of certain of the passages of the heat exchanger, the view being taken on the line 2—2 of FIG. 1.

The vapor passages or passageways 12 as defined by adjacent heat transfer plate members 10 are provided with separator plates 48, FIG. 2. The plates 48 as shown in FIG. 2 are of a wave configuration but said plates may readily assume various shapes while acting as conductive fins to provide extended transfer surfaces to conduct heat to the heat transfer plates. The separator plates or fins 48 can be formed from various highly conductive materials, such as copper or aluminum, and they can also be treated with surface treatments to promote drop-wise condensation. As an illustration, the surfaces of said plates could be treated with Teflon which is a coating that reduces surface tension and causes liquid to collect in drops without wetting the surface. In addition, the separator plates could have holes formed therein which would permit the vapor to pass therethrough and which would also tend to break up the condensate streams as they flowed down through the vapor passages.

It is desirable to have a rather uniform pressure applied over the entire area of the pressure plates 16 so that all of the passage separators are uniformly pressed against the heat transfer plates 10. Such an arrangement provides for good heat transfer contact so that the separator plates tend to act as extended heat transfer surfaces. Inasmuch as the clamping plates 28 are secured only at the edges they would tend to compress the transfer plates at the edges and thus would apply very little pressure at the middle of said plates. Thus, in order to insure rather uniform pressure of the stack of transfer plate members 10 the cover member 24 has a cavity formed therein which is adapted to receive a rubber bag 50 which is filled with pressurized gas in order to transmit uniform gas pressure to the pressure plate 16. While a rubber bag has been shown only in the cavity in cover 24 it is to be understood that a similar bag would be employed in the cavity in cover 26 for applying pressure to the plate 16 associated with cover 26. The foregoing would be effective under many conditions for applying pressure to the pressure plate 16, however, the arrangement does have certain disadvantages if the heat exchanger is to be submerged into the ocean for use in conjunction with a sea thermal power unit. Due to the differential in pressure that would develop dependent upon the depth to which the heat exchanger was lowered into the ocean, it would be difficult to maintain the system at a vapor pressure wherein the vapor passages would always be squeezed together to maintain good contact between the separator plates and the heat transfer plates 10.

An alternative to accomplishing the foregoing would be to fill the cavity in the cover 24 and 26 with a liquid, instead of a gas, as it is desirable to keep the pressure of the fluid in the cavity defined by the covers 24 and 26 slightly higher than the system vapor pressure, which is the vapor introduced in the cover 20 through the inlet opening 52. In this way the vapor passages 12 are always squeezed together to maintain good contact between the separator plates 48 and the heat transfer plates 10.

Figure 3:
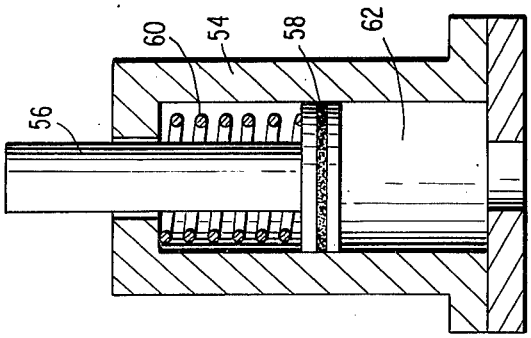
FIG. 3 is a vertical sectional view of a piston device for use with the heat exchanger of FIG. 1 to maintain an exterior pressure.

The foregoing can be accomplished by filling the cavity in the covers 24 and 26 with liquid and interposing a spring-loaded piston, such as shown in FIG. 3, between the vapor space in the cover 20 and the liquid in the cavity in the cover 24 and 26. In this connection the casing 54 is provided with an aperture at its lower end that is connected to the liquid in the cavity 24 and 26. The piston 56 is provided with an O-ring seal 58 and a spring 60 surrounds the stem of the piston and is interposed between the head of the piston and the end of the casing 54. The space in the casing 54 within which the spring is positioned is connected to the vapor pressure in the cavity in the cover 20 while the space 62 in the lower portion of the casing 54 below the piston 56 is connected to the liquid in the cavity defined by the covers 24 and 26. Thus the liquid in the cavity 24 and 26 which is under a slight pressure forces the piston 56 upwardly against the spring 60 and is always under higher pressure than the pressure in the spring chamber above the piston. Thus in lowering the condenser or evaporator into the ocean the vapor pressure is maintained fairly close to the water pressure and cavity pressure is always higher than the vapor pressure by the additional pressure that is added by the spring force on the piston. It is to be noted that the piston could be replaced by a spring-loaded bellows or a flexible diaphragm, not shown.

A further alternative to the foregoing would be to provide the covers 24 and 26 with a slightly dished configuration, as shown on the right in FIG. 1, wherein the cover would have a Belleville spring characteristic that would act like the bottom of a conventional oil can upon being squeezed. Thus as liquid is introduced into the cavity, under the action of a pump, the liquid pressure would increase to a point at which time the dished cover would expand outwardly at a nearly constant pressure. If the cavity is then closed the liquid contained therein can expand or contract slightly and thus maintain a practically constant pressure on the plates 16 above external water pressure when the heat exchanger is submerged into the ocean.

The heat exchanger as shown in FIG. 1 is readily assembled by stacking all of the plate members 10 together between the pressure plates 16. In this connection it is to be born in mind that the plates prior to stacking are assembled with respect to one another so that the separator strips or plates 15 are interposed between adjacent plates and also that the separator plates 48 are interposed between the plate members in the manner as illustrated in FIG. 2. Once these plate members have been assembled between the pressure plates 16 the gasket flanges 18 are then applied to the ends of the plates and the side and end covers 24 and 26 and 20 and 22 are applied to the gasket flanges and are secured in place by means of the clamp plates 28 and the bolts 44. With the heat exchanger so assembled, the cover 20 may have a vapor such as propane introduced through the inlet opening 52 and water may be introduced in the horizontal passages defined by the plate members 10 and the separator strips or plates 15. Thus the propane vapor flows downwardly through the vapor passages or passageways 12 and over the separator plates 48 so as to condense and the liquid so formed is then collected in the cover 22 where it is discharged through a suitable outlet 64. The pressure plates 16 are maintained under suitable pressure by means of gas introduced into a rubber bag 50 provided in the cavity defined by the covers 24 and 26 or by the alternative method of introducing liquid under slight pressure in said cavity and connecting same to a piston casing 54 in the manner as set forth herein above.

Figure 4:
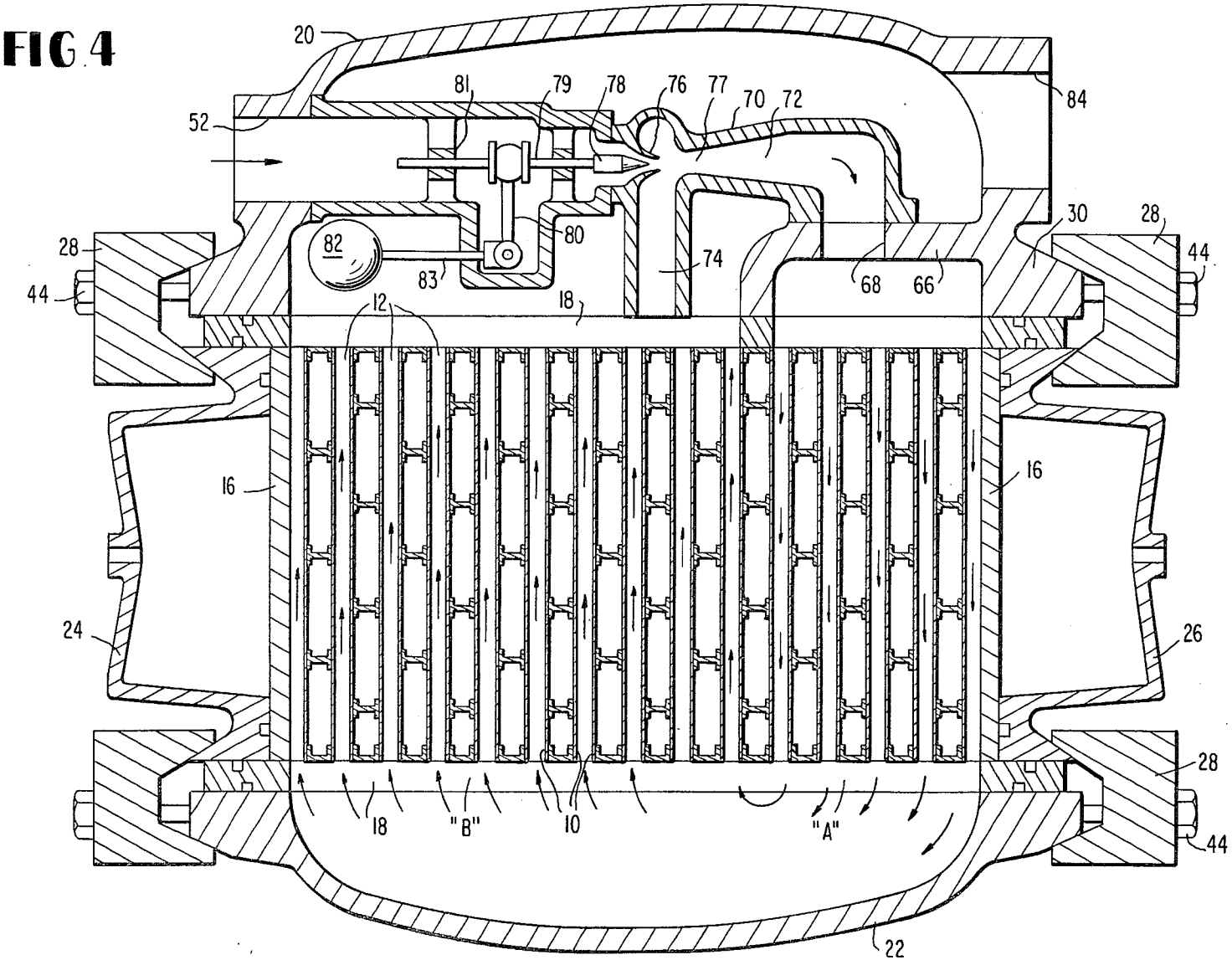
FIG. 4 is a vertical sectional view of another heat exchanger embodying the present invention.

There is shown in FIG. 4 a modification of the heat exchanger shown in FIG. 1 but it is to be noted that in FIG. 4 the plate members 10 are arranged in stacked formation between pressure plates 16 and gasket flanges 18 are secured to said plates in the same manner as set forth with respect to the heat exchanger of FIG. 1. The parts in FIG. 4 that correspond to the same parts in FIG. 1 have been identified by the same reference numerals.

The cover member 20 is formed with an inwardly extending web or partition 66 that terminates in a depending segment which engages the gasket flange 18 and a pair of plate members 10 so as to divide the transfer plate members 10 into sections "A" and "B". The web 66 is formed with an aperture 68 that coincides with a discharge opening in a housing structure 70 that is supported by said web 66 and the inlet opening 52 in the cover member 20.

The housing 70 is provided with a through passageway 72 and a depending passage 74 that terminates adjacent the upper edge of the plate members 10. The housing 70 has formed therein a nozzle 76 with the portion of the passageway 72 at the confluence of nozzle 76 and passage 74 constituting a diffuser section 77 of a jet pump. The jet pump consists of the accelerating jet nozzle 76, the pump suction passage 74, the mixing section at the intersection of outlet of nozzle 76 and passage 74, and the diffuser section 77, where the high velocity of the jet and mixed suction fluid is converted to higher pressure at discharge aperture 68. The nozzle 76 has associated therewith a plug valve 78 that is carried by a rod 79 supported in suitable spider members 81 in the housing 70. A lever 80 is connected to the rod 79 and said lever has one end of an arm 83 connected thereto with the other end secured to a float ball 82. The cover 20 is also provided with a vapor outlet 84.

In the heat exchanger or evaporator as shown in FIG. 4, a liquid enters the cover 20 through the inlet opening 52 and flows through the passageway 72 and the aperture 68 in the web 66 where it is directed into the passageways located in section "A". The passage of fluid through nozzle 76 reduces the pressure, and increases the velocity. The reduced pressure causes passage 74 to draw liquid into the mixing chamber at the confluence of nozzle 76 and passage 74. This mixture of liquid, at somewhat reduced velocity, enters diffusing section 77, where velocity is gradually reduced and the kinetic energy is converted to increased pressure, thereby acting as a jet pump to pump liquid from passage 74 to discharge aperture 68, and thence down through the liquid passageways in section "A". The liquid will then be directed through the vertical passageways in the section "A" where it will be heated to a temperature close to the boiling temperature as it flows into the lower cover 22. The heated liquid when flows toward the left of the cover 22 into the section "B" and up through the passageways 12 in the left-hand portion of the structure as shown in FIG. 4. As the liquid flows through the passageways in section "B" a boiling occurs and the vapor bubbles leave the surface of the liquid in the top cover 20 in the area surrounding the jet pump, and from here the vapor flows out through the varpor outlet 84. The float ball 82 operates the lever 80 which in turn operates the plug valve 78 on the inside of the nozzle 76 and this controls the flow to maintain a slight level of liquid above the vapor passageways 12. The heat exchanger as shown in FIG. 4 is similar in its construction or assembly to that as shown in FIG. 1 in that the multiple heat transfer plates and separators are clamped together in a stack by means of the gasket flanges and pressure plates, and the entire assembly is held under pressure by the pressurized chambers provided in the covers 24 and 26.

It should be noted that with this construction it is easily possible to divide the evaporator section or the condenser sections into separated sections along the water passages as described in Applicant's prior U.S. Pat. No. 3,312,054. This division of the evaporators and condensers into various separated sections along the path of the water flow gives a distinct thermodynamic advantage in making the temperature difference between the fluid average at a higher value than they would if the boiling or condensing chambers were completely interconnected along the full length of the heat exchanger in the direction of the water flow. The principles of this advantage are clearly set forth in the aforementioned patent.

In order to divide this construction into sections which have separate liquid and vapor connections along the water flow path it is possible to use separate inlets and discharges from each section and seal the division between sections by having the liquids and vapor sections divided into compartments which brings the sealing plate against the face of the vapor and liquid flow passages and have a wall between the various liquid and vapor sections. These sections can also be sealed between adjacent vapor passages by pumping a sealant such as rubber or some solidifying elastomer into the vapor passages at the sealing wall. As a typical preferred arrangement for the evaporators and condensers it would probably be advisable to have four separate liquid inlets, four separate liquid and vapor chambers, and four separate vapor outlets at different positions along the water flow path. The heat exchanger plates themselves, the pressure plates on the bundle or stack, and the pressurizing chambers could extend for the full length of the water passages, and only the vapor chambers and liquid chambers at the tops and bottoms of the exchanger need to be separated into different chambers. While there are many minor variations that are possible, it is believed that the present disclosure describes the basic principles of operation of this type of exchanger which is believed to have great advantage in that it can be assembled mechanically, with essentially no brazing of the entire assembly, and in addition it can be taken apart completely for cleaning or for reclaiming defective heat exchanger plates after long periods of service. Thus, in a sea water power plant such as described in Applicant's aforementioned patent it becomes readily apparent wherein heat exchangers of the type as disclosed herein could be utilized and arranged in the aforementioned manner.

Figure 5:
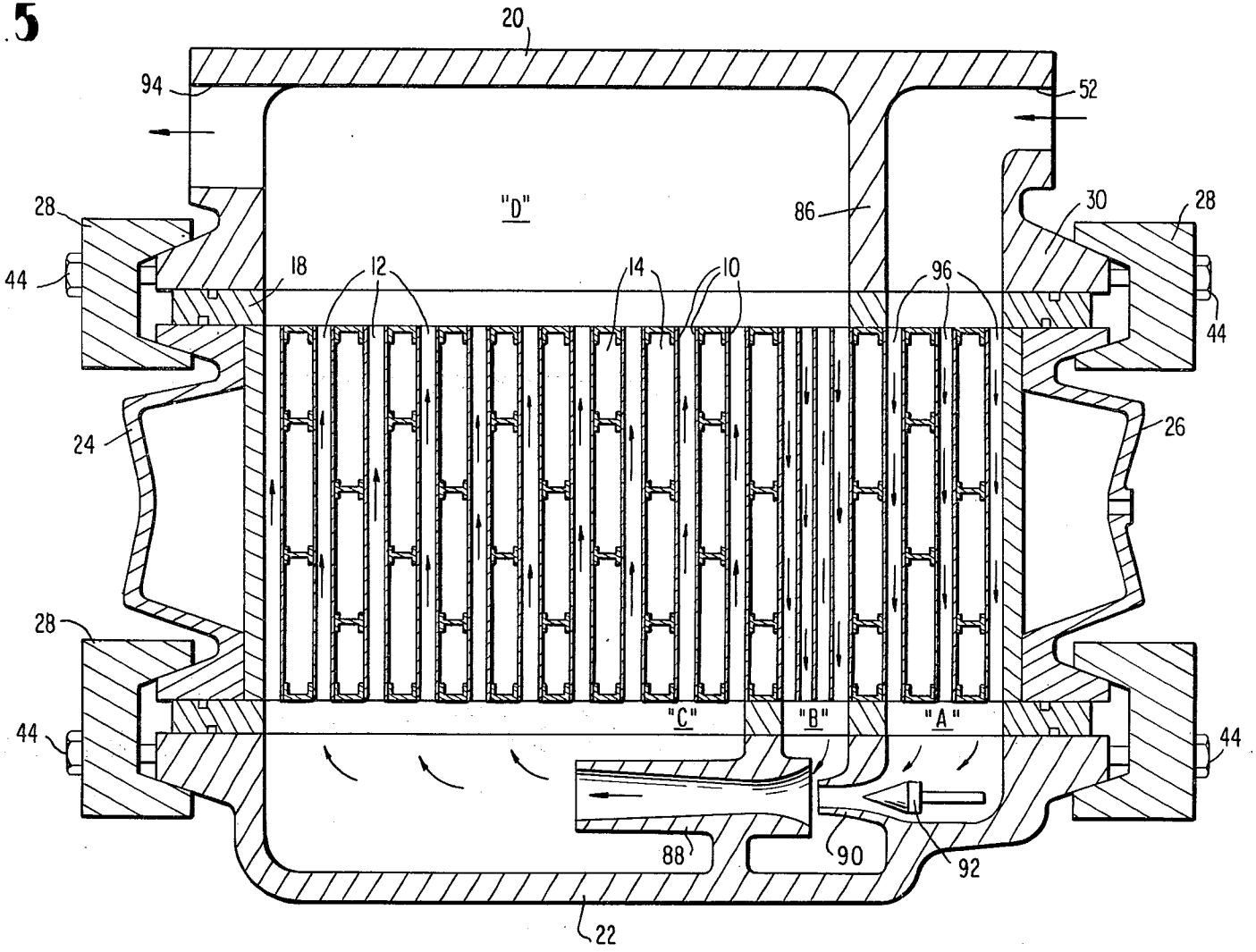
FIG. 5 is a vertical sectional view of still another heat exchanger embodying the present invention.

There is shown in FIG. 5 another modified form of heat exchanger with the parts of said heat exchanger that correspond to those shown in FIG. 1 being identified by the same reference numerals. The heat transfer plates 10 are arranged into section "A" wherein channels 96 communicate with the inlet compartment of the top cover 20. In addition, the bottom cover 22 is formed with sections "B" and "C" and it is to be noted section "B" provides communication between the outlet section "D" of the top cover 20 and the bottom cover 22 while section "C" provides communication between the bottom cover 22 and the top cover 20. It is to be noted that in the section "B" the passageways are formed without separators so that there is less contact with heat transfer plate members as there would be in the passageways 12 in section "C" in said heat exchanger. The top cover 20 is formed with an interior depending partition 86 which divides said cover into an inlet and an outlet compartment. The lower cover 22 has positioned therein a jet pump diffuser 88 which has associated therewith a jet pump. There is provided in the bottom cover 22 a jet nozzle 90 and a valve plug 92 that is associated with said jet nozzle 90. In the jet nozzle 90 liquid from section "A" is increased in velocity and decreased in pressure as it flows out of the nozzle. At the reduced pressure it draws liquid from section "B", and the mixture flows through diffuser 88 and discharges into section "C" at a higher pressure than the liquid in section "B". The liquid flows up through passages 10 from section "C", where most of it boils into vapor that discharges from passage 94. The excess liquid overflows into the down flow passages at the right of section "D", and flows through these passages to section "B". This provides continual circulation of liquid in order to insure completely wetted passages. The valve plug 92 is controlled by a liquid level sensor in section "D" to maintain a continual level of liquid in section "D".

In the heat exchanger shown in FIG. 5 there is better control of the temperature of the incoming liquid as it moves through the inlet opening 52 and incoming compartment and flows down through the channels 96 in section "A" and then through the jet nozzle 90 into the jet pump diffuser 88 under the action of the jet pump. In this arrangement, this cold liquid flowing through the inlet opening 52 contacts the heat transfer plates or surfaces in the section "A" so that there is a transfer of heat to the liquid and said liquid can pass through the channels 96 at a higher pressure than that which exists downstream from from the jet pump. Thus, the water flowing through the water passages in the heat transfer plate members can be utilized to super heat the liquid flowing through the channels 96 slightly above the boiling point corresponding to the pressure in section "C" so that when the liquid flows through the jet nozzle 90 and then through a reduced pressure area the liquid having been super heated slightly above its boiling temperature in said passages can then start flashing into vapor in the jet pump, thus increasing the volume and producing bubbles in the liquid prior to the liquid entering the passageways 12 in section "C".

The heat exchanger is normally filled so that during operation the liquid level is above the level of the passages in section "B" and the overflow liquid then flows down through the passages in section "B" from whence it moves into the suction of the jet pump and the jet pump diffuser 88. The passages in section "B" are provided with less heat contact transfer surfaces than the passageways 12 in section "C" as it is regarded that the passages in section "B" should not be heated as much on the way down as the passageways in which the liquid is traveling upward or through section "C". Thus there is little heat transfer in the liquid flowing through the passages in section "B" so that there is very little boiling and not many bubbles are formed in said liquid, and in this way the mean density of the liquid flowing down is kept high so the mean density of the liquid in the passages of section "B" entering the suction of the jet pump and the diffuser 88 will be higher than the mean density of the liquid and bubble combination in the passageways 12 in section "C" wherein the liquid and bubbles are flowing upwardly from the lower cover member to the upper cover member. This arrangement tends to increase the rate of circulation of the liquid as it flows downwardly and into the suction of the jet pump and in turn promotes more rapid flow of liquid up through the boiling passageways in section "C" thereby improving heat transfer.

The valve plug 92 may be operated in the same general manner as the valve plug as shown in FIG. 4 or by any other suitable control mechanism as many operating means for automatically controlling the level of the liquid in the heat exchanger are possible and same are believed to be well known in the art. Thus, as the liquid moves up through the passageways in section "C" the vapor created by the boiling of said liquid will collect in the top cover 20 and flow through the discharge outlet 94.

While the general principles of construction and operation of the heat exchanger as shown in FIG. 5 are similar to those as shown in FIG. 4 it can be noted that rearranging the down-coming liquid passages into two separate sets of passages identified as sections "A" and "B", with the incoming liquid separated from the recirculated liquid permits the incoming liquid to be passed through at higher pressure, and at higher velocity than can be achieved with the recirculated liquid. Therefore, the heat transfer from water to liquid is improved because of the higher velocity in the liquid passages. On the other hand, the recirculated liquid is not heated as much on the way down and high heat transfer rates are not desirable on that liquid since it is already practically at the boiling point of the fluid.

Although the foregoing description is necessarily of a detailed character, in order that the invention may be completely set forth, it is to be understood that the specific terminology is not intended to be restrictive or confining and that various rearrangements of parts and modifications of detail may be resorted to without departing from the scope or spirit of the invention as herein claimed.

I claim:

1. A heat exchanger comprising a plurality of plates arranged in pairs in vertical planes and in spaced parallel relation to one another between a plurality of pressure plates, each pair of plates defining a passage therebetween and each pair of plates defining a passageway between adjacent pairs of plates, gasket flanges secured to the edges of said plates and supported on said pressure plates, cover members for the top, bottom and sides of said plates, clamping plates for engaging said side and top cover members and said side and bottom cover members to force said top and bottom cover members against said gasket flanges contemporaneous with compressing the side covers against said pressure plates to force said plate members towards one another and retain said heat exchanger in an assembled condition.

2. A heat exchanger as set forth in claim 1 wherein said side cover members define a cavity for the reception of a fluid under pressure and said top cover member defines a vapor chamber, a spring biased piston disposed within a casing connected to said cavity with the portion of said casing containing said spring connected to said vapor chamber for maintaining said fluid and said plates under pressure.

3. A heat exchanger as set forth in claim 1 wherein said side cover members are slightly dished and capable of flexing, a liquid introduced into said covers with said covers constituting a spring to maintain the liquid at a pressure higher than the pressure external to said heat exchanger.

4. A heat exchanger as set forth in claim 1 wherein said pairs of plates are arranged with a plurality of separator strips positioned between the plates of each pair to define a plurality of superimposed passages between each pair of plates.

5. A heat exchanger as set forth in claim 4 wherein separator plates are positioned in said passageways to hold said plates apart and with said separator plates constituting conductive fins for said plates.

6. A heat exchanger as set forth in claim 5 wherein said side cover members define cavities for the reception of pressurized fluidic means engagable with said pressure plates for uniformly pressing said separators against said plates.

7. A heat exchanger as set forth in claim 1 wherein said top cover is provided with an interior apertured partition engaging said gasket flange and certain of said plate members to divide said plate members into a pair of sections with one section heating a liquid flowing through said apertured partition and said passageways to a temperature less than boiling and delivering said heated liquid to passageways in the second section for heating said liquid to a boiling temperature to create a vapor which is discharged from said top cover.

8. A heat exchanger as set forth in claim 7 wherein said top cover is provided with a housing having a passageway therethrough connected to an inlet of said top cover and the aperture in said partition, a depending passage connected to said housing and communicating with said passageway and the interior of said top cover, means connected to said passageway for directing fluid from said inlet and the interior of said top cover to the aperture in said partition.

9. A heat exchanger as set forth in claim 8 wherein a nozzle is formed in said passageway, said passageway configured to define a diffuser action with said nozzle and depending passage and diffuser section constituting a jet pump.

10. A heat exchanger as set forth in claim 9 wherein a plug valve is mounted in said housing and engageable with said nozzle, a lever connected to said plug valve and a float member within said top cover connected to said lever for moving said plug valve into and out of engagement with said nozzle.

11. A heat exchanger as set forth in claim 1 wherein said top cover is provided with a partition engaging said gasket flange and certain of said plates to divide said plates into a pair of sections, openings formed in said top cover with one of said openings constituting an inlet for directing a fluid into a section and through the passageways thereof with another fluid flowing through the passages of said section to transfer heat to the liquid in said passageways, a bottom cover forming a chamber to receive the liquid from the passageways of said first section and deliver same to passageways in said other section for elevating the temperature of the liquid in the passageways of the second section by the fluid flowing through the passages of the second section.

12. A heat exchanger as set forth in claim 11 wherein said second section is provided with a plurality of channels providing communication between the top cover and the bottom cover of the second section.

13. A heat exchanger as set forth in claim 11 wherein a jet pump is mounted in said top cover and connected to said inlet opening for said section.

14. A heat exchanger as set forth in claim 12 wherein the second section directs heated liquid and vapor to the top cover with the vapor flowing through the opening in said top cover and the liquid flowing through said channels to the bottom cover for recirculation through the passageways of said second section.

15. A heat exchanger as set forth in claim 11 wherein said bottom cover is formed with a partition having a flow path therethrough and providing communication between the plurality of channels and the passageways of said second section.

16. A heat exchanger as set forth in claim 15 wherein said bottom cover has a second partition formed therein with a nozzled aperture to provide communication between said first and second sections, a valve plug engaging said nozzled aperture to control the flow of liquid from said first section to said second section.

17. A heat exchanger as set forth in claim 11 wherein said bottom cover is provided with a jet pump diffuser and dividing said cover into at least two sections.

18. A heat exchanger as set forth in claim 17 wherein said jet pump diffuser divides said second section into a pair of sections with one of said last-mentioned pair constituting a recirculating section.

19. A heat exchanger as set forth in claim 17 wherein said bottom cover is formed with a jet nozzle and defining three sections in said bottom cover in conjunction with said jet pump diffuser.

20. A heat exchanger as set forth in claim 19 wherein the liquid flowing through the passageways in the first section passes through said jet nozzle and the liquid flowing through said third section passes through said jet pump diffuser.

* * * * *